US005550921A

United States Patent [19]

Freadman

[11] Patent Number: 5,550,921

[45] Date of Patent: Aug. 27, 1996

[54] STEREO SOUND SOURCE FOR PORTABLE COMPUTER

[75] Inventor: Tommyca Freadman, Goshen, N.Y.

[73] Assignee: Sparkomatic, Milford, Pa.

[21] Appl. No.: 441,662

[22] Filed: May 15, 1995

[51] Int. Cl.[6] ..... H04R 5/00

[52] U.S. Cl. ..... 381/24; 381/159; 381/188; 181/145; 181/160; 181/182

[58] Field of Search ..... 381/24, 159, 188, 381/205, 88, 90, 182; 181/144, 145, 148, 160, 182, 189, 190, 199

[56] References Cited

U.S. PATENT DOCUMENTS 5,092,424 3/1992 Schreiber et al. ..... 181/145

FOREIGN PATENT DOCUMENTS 0216700 8/1989 Japan ..... 381/24
405191881 7/1993 Japan ..... 381/24

*Primary Examiner*—Curtis Kuntz
*Assistant Examiner*—Ping W. Lee
*Attorney, Agent, or Firm*—Graham & James LLP

[57] ABSTRACT

A dual-speaker unit providing improved stereo base response and directionality for portable computer applications is disclosed. The small speakers direct low end frequencies into a mixing chamber which directs these frequencies out through a central exit port, thereby providing clearer base response without sacrificing psychoacoustic directionality.

The speakers are mounted on the mixing chamber and also rotatable relative to it, for adjustable stereo imaging and compact portability.

3 Claims, 2 Drawing Sheets

STEREO SOUND SOURCE FOR PORTABLE COMPUTER

BACKGROUND OF THE INVENTION

1. Field of the Invention

The present invention is directed to computer output devices. More particularly the present invention is directed to providing stereo audio for portable computers.

2. Discussion of Related Art

Personal computers require only rudimentary speaker devices for tasks such as wordprocessing, where sound is used as the auditory equivalent of dashboard warning light. The transducers producing such beeps and whistles, because they only produce sounds at the upper end of the auditory spectrum, are by nature quite compact and inexpensive. However, they are not capable of reproducing complex sounds, or pitches beyond a limited frequency range.

Multimedia presentations require high quality voice reproduction as well as the ability to accurately reproduce other types of complex audio material. Moreover, for on-location presentations, high-quality sound is important to the over-all attractiveness of the materials generated by a company's sales team.

Thus, it is highly desirable to provide a stereo sound unit for portable computer workstations that is compact and inexpensive as possible but can still provide the stereo separation and tonal range needed for high-fidelity sound reproduction.

SUMMARY OF THE INVENTION

In accordance with the present invention a stereo sound source for a portable computer has first and second speaker enclosures with respective bass ports. First and second cylindrical sound guides having first and second ends are each connected at the first end to a respective speaker enclosure and, on the second end, to a mixing chamber. The mixing chamber is connected by a third sound guide, through an exit port, to ambient air.

DESCRIPTION OF THE DRAWINGS

The features and advantages of the present invention will be better understood when the detailed description of the preferred embodiments is given below is considered in conjunction with the drawing wherein.

DETAILED DESCRIPTION OF THE PREFERRED EMBODIMENTS

Figures 1A, 1B:
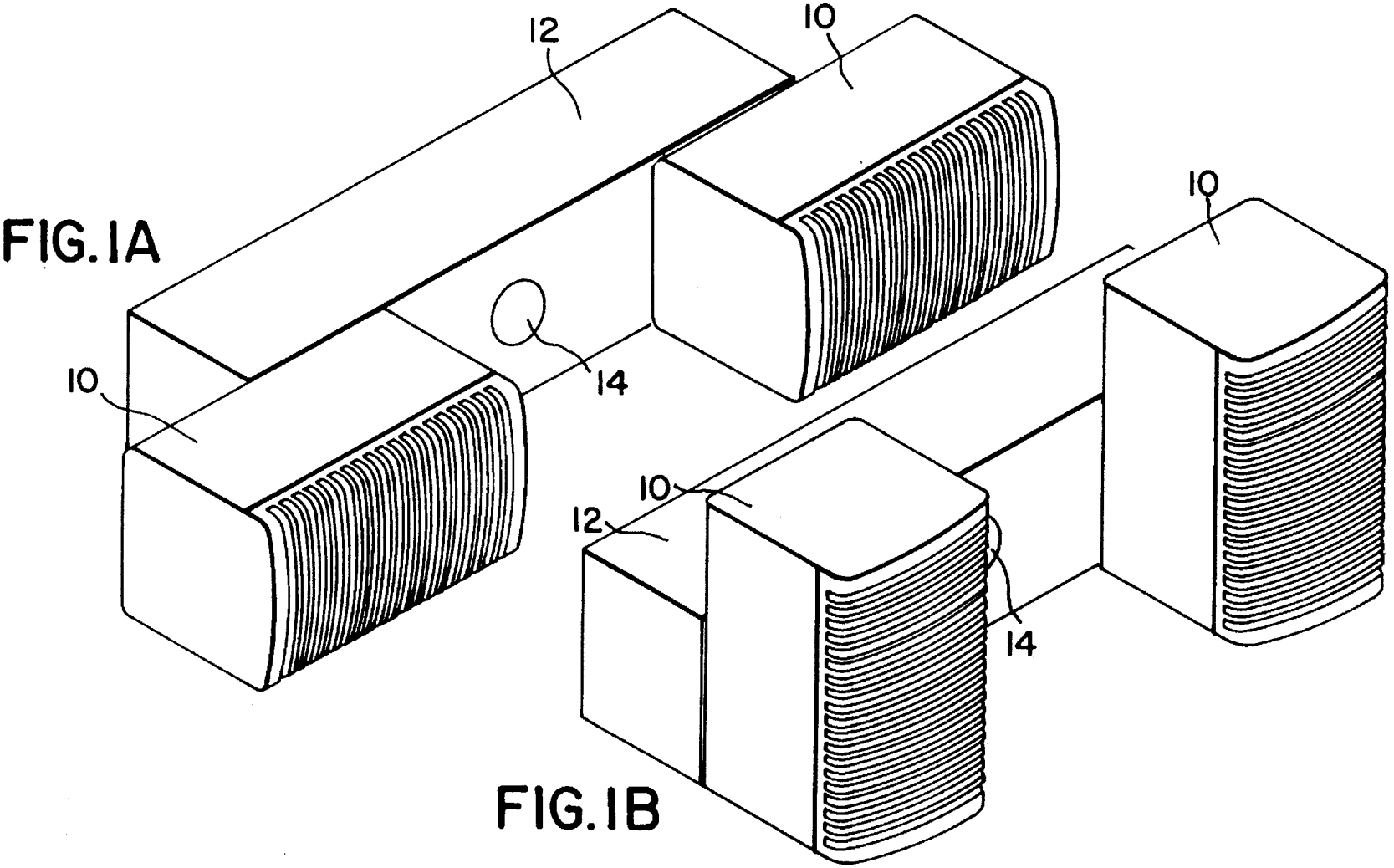
FIGS. 1*a* and 1*b* show an improved stereo sound source in accordance with the present invention.

In FIGS. 1*a* and 1*b*, two enclosed speaker units 10 are rotatably attached to an oblong mixer cavity 12 having a forward-facing resonator port 14. The units 10 have a sturdy, protective grill 16 and can be aligned either vertically or horizontally relative to the exterior of the cavity. The horizontal alignment in FIG. 1*a* provides maximum separation. The vertical alignment in FIG. 1*b* is more suitable for a speaker unit that is placed on a surface that is below eye level at close range.

Figure 2:
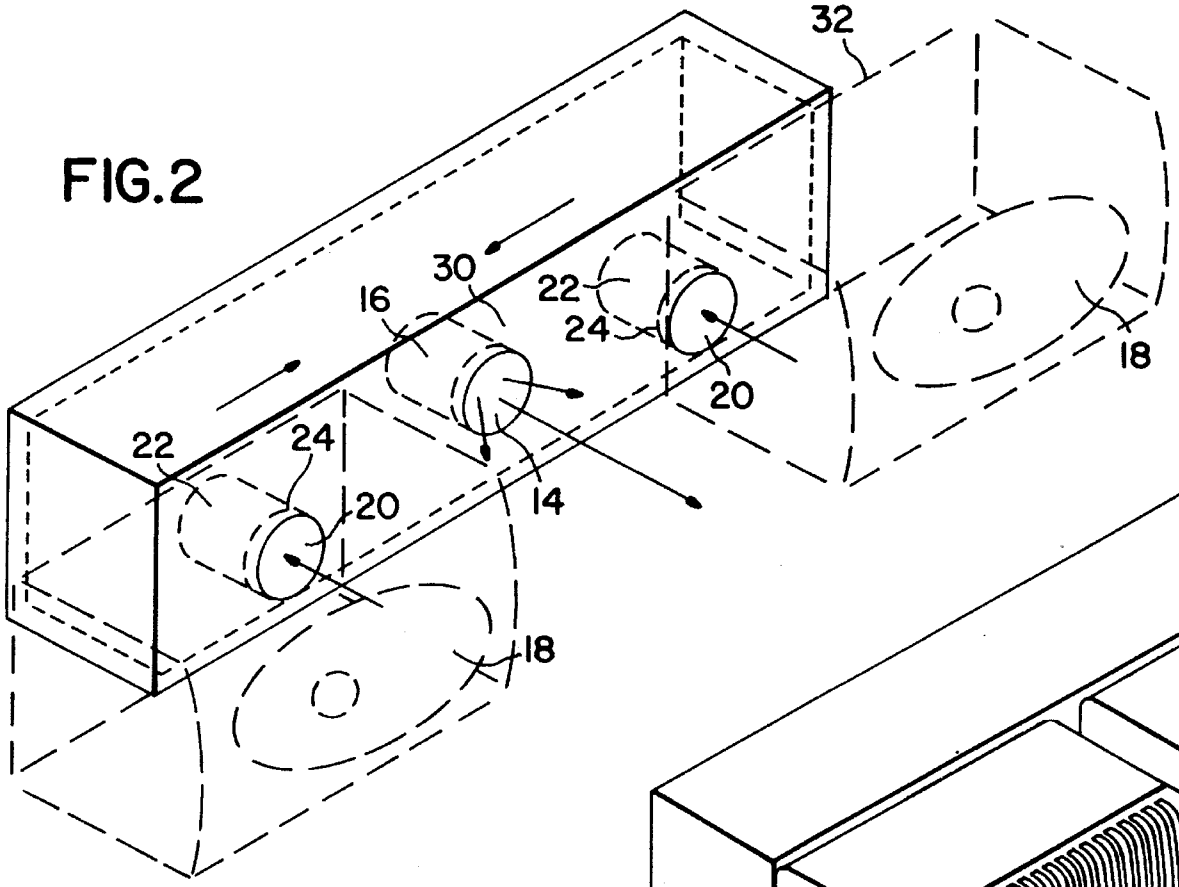
FIG. 2 shows the internal structure of the stereo sound source of FIG. 1.

FIG. 2 shows respective bass ports 20 on the speaker enclosures 10. The bass ports 20 and the mixer port 14 open into respective hollow cylindrical sound guides 16, 22.

The mixer guide 16 is attached to the center of the front inside surface 30 of the mixer cavity 12. The bass guides 22 are attached to respective bass ports 20 located on the back wall 32 of respective speaker enclosures 10 near the center of one end of that wall 32.

The bass guides 22 are snuggly inserted into the mixer cavity 12 through guide ports 24 in the front wall of the mixer 12. All three guides 16, 22 extend perpendicular to the surface on which they are mounted.

These guides 16, 22 acoustically connect the ports 14, 20, to the resonant air volume in the mixer cavity 12. The air volume in the mixer cavity 12 amplifies sounds at the lower end of the spectrum that are produced by the respective speaker transducers 18 and selectively passed by the guides 22 into the mixer 12. This lower frequency sound then exits the mixer cavity 12 through the forward-facing mixer port 14.

Figure 3:
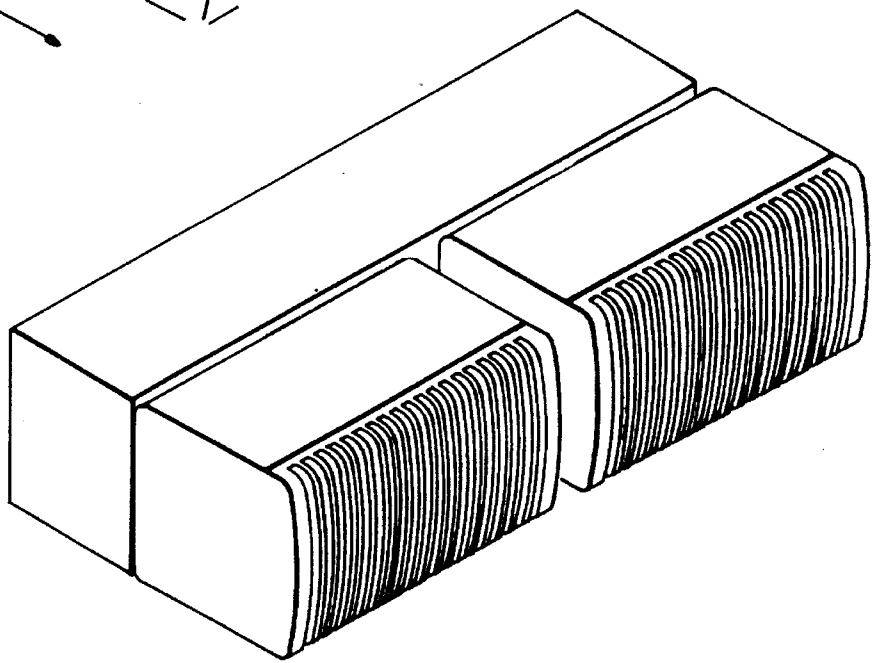
FIG. 3 shows the stereo sound source of FIG. 1 closed for travel.

FIG. 3 shows the speakers 10 after the bass guides 22 have been rotated in their guide ports 24 until the enclosures are flush with the front profile of the mixer cavity 12. This provides a highly compact unit for shipment.

It will be apparent to one skilled in the art that modifications and variations of the disclosed embodiment are possible within the spirit and scope of this invention which is defined by the claims appended below.

I claim:

1. A stereo sound source for a portable computer, comprising:

first and second speaker enclosures, each enclosure having a respective bass port therein;

a bass guide tube attached to the respective bass port on the outside of each enclosure;

a mixing chamber having respective guide ports through a wall of said chamber and a mixer port through a given wall of said chamber, said bass guide tubes each being rotatably inserted through a respective guide port into said mixing chamber; and a mixer tube attached to said mixer port on an inside surface of said given wall so as to provide an acoustic connection through said mixer tube to the outside of said mixing chamber, so that lower frequencies produced by each speaker are conducted to the mixing chamber and out through the mixer port, whereby a compact unit having improved stereo sound is provided for portable computer applications.

2. The stereo sound source of claim 1 wherein said mixer port is on the same wall of the mixing chamber as said guide ports.

3. The stereo sound source of claim 1 wherein each of said bass ports is located at one end of said respective enclosure.

* * * * *